US006427407B1

(12) United States Patent
Wilson

(10) Patent No.: US 6,427,407 B1
(45) **Date of Patent: *Aug. 6, 2002**

(54) MODULAR BUILDING PANELS AND METHOD OF CONSTRUCTING WALLS FROM THE SAME

(75) Inventor: Stuart Wilson, Hillsboro, OR (US)

(73) Assignee: Soloflex, Inc., Hillsboro, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/466,441

(22) Filed: Dec. 17, 1999

Related U.S. Application Data

(63) Continuation-in-part of application No. 09/282,584, filed on Mar. 31, 1999, now abandoned.

(51) Int. Cl.[7] ..... E04C 2/34
(52) U.S. Cl. ..... 52/481.1; 52/483.1
(58) Field of Search ..... 52/204.1, 210, 52/272, 284, 309.4, 483.1, 745.1, 745.13, 745.16, 267, 265, 269, 275, 481.1

(56) References Cited

U.S. PATENT DOCUMENTS 3,466,821 A * 9/1969 O'Shaughnessy ..... 52/204.1
3,626,649 A * 12/1971 Ohkawa ..... 52/204.1
4,463,531 A * 8/1984 Peretto ..... 52/204
4,578,909 A * 4/1986 Henley ..... 52/90
4,813,193 A * 3/1989 Altizer ..... 52/210
5,095,671 A * 3/1992 Mitani ..... 52/210
5,417,023 A * 5/1995 Mandish ..... 52/348
5,638,651 A * 6/1997 Ford ..... 52/309.7
5,692,350 A * 12/1997 Murphy ..... 52/213
5,787,651 A * 8/1998 Horn ..... 52/144

* cited by examiner

*Primary Examiner*—Beth A. Stephan
(74) *Attorney, Agent, or Firm*—Chernoff, Vilhauer, McClung & Stenzel, LLP

(57) ABSTRACT

A method for constructing prefabricated modular building panels includes providing a plurality of full wall height panels in several widths and full wall height corner elements which can be assembled to provide walls for a building of almost any size. The method also includes providing less than full height header and sill panels in several widths which can be used to install windows and doors. A window is installed between a header and sill panel having a width which is greater than the width of the window by placing studs between the header and sill panels at each side of the window and at each side of the header and sill panels. A door is installed under a header panel having a width which is greater than the width of the door by building a frame on each side of the door below the header panel. The panels are made with a frame of interconnected steel studs and steel top and bottom tracks. Pieces of structural building material are rigidly attached to the tracks and project from the front edges of the track by a predetermined distance. Strips of insulating material attached to the front edges of the studs have a thickness substantially equal to this first predetermined distance.

16 Claims, 16 Drawing Sheets

MODULAR BUILDING PANELS AND METHOD OF CONSTRUCTING WALLS FROM THE SAME

This application is a continuation-in-part of U.S. patent application Ser. No. 09/282,584 filed Mar. 31, 1999 now abandoned.

BACKGROUND AND SUMMARY OF THE INVENTION

It is becoming more common to construct building walls from panels that had been prefabricated in a factory. These panels are often made with a steel frame, since steel is lighter, less costly and results in a panel which is more true than a wood framed panel. These panels heretofore have been constructed with a single panel for each wall or a few rather large panels when the wall is too long for a single panel.

There are several shortcomings with these prior art prefabricated building panels. Because the panels typically cover an entire wall, they are quite heavy and it takes a large truck to deliver them to the site and several workers to erect them. In addition, because the panels typically are custom built for a particular job, the panels must be ordered several days in advance. This can result in delays to the project if the panels are not ordered enough in advance or their fabrication is delayed.

Another shortcoming of steel frame panels is that steel has a high thermal conductivity compared to wood, which makes it difficult to obtain the wall "R" value required by most building codes. Finally, building tradesman, such as carpenters, plumbers, electricians and the like, are use to working with wood framed buildings and have an aversion to working with steel framed panels.

In a preferred embodiment the subject invention overcomes these shortcomings of the prior art building panels by providing a method for constructing building walls from prefabricated modular panels wherein a plurality of full wall height panels are provided in several widths, all of which are less than full wall width. In addition, a full height corner element is provided. Thus, almost any length wall can be built by attaching appropriate width panels to one another and to corner elements.

In another preferred embodiment, header and sill panels are provided in several widths having less than full wall height. Whenever a window is to be installed a sill panel having a width which is greater than the width of the window and a height that causes it to extend substantially between the bottom of the wall and the bottom of the window is installed between adjacent panels at the bottom of the wall. A header panel having the same width as the sill panel and a height equal to the distance between the top of the window and the top of the wall is installed at the top of the wall. The window is then placed between the header and sill panels and studs are installed between the header and sill panels on each side of the window and at each side of the header and sill panels.

Whenever a door is to be installed a header panel having a width which is greater than the width of the door and a height equal to the distance between the top of the door and the top of the wall is installed between adjacent panels at the top of the wall. The door is then placed under the header panel and a frame is built around the door and below the header panel.

Another preferred embodiment of the invention relates to a hybrid modular building panel with a frame having a pair of vertical metal studs which are rigidly interconnected at their top and bottom ends by horizontal metal tracks. Depending on the width of the panel one or more intermediate studs may be located between the studs at the ends of the panel. A piece of structural building material is attached to each track and projects from the front edge of the track by a first predetermined distance. Strips of insulating material, such as high density foam, are attached to the front edges of the studs. The thickness of the pieces of insulating material is equal to the first predetermined distance. Thus, the front edges of the insulating strips are coplanar with the front edges of the pieces of structural building material.

The structural building material allows interior surface material, such as sheet rock or paneling, to be tacked to the panel at the top and bottom with a hammer and nails in order to hold the material in place while it is attached to the steel studs with screws. Crown and base molding can also be attached to the pieces of structural building material with hammer and nails. In addition, slots can be cut out of the pieces of insulating material and a piece of blocking lumber placed in these slots and attached to the studs, in order to attach cabinets to the walls. Finally, blocks are attached to the intermediate studs so that electrical boxes can be attached to them with hammer and nails.

Another preferred embodiment of the invention relates to a modular building system which includes a first frame unit having a pair of vertical first studs which are separated from one another by a predetermined center-to-center separation and have a first sheet of sheathing attached to them. The sheet of sheathing has a first edge which is inwardly offset from the side of the outside stud by a predetermined offset. The sheet of sheathing has a width equal to twice the predetermined center-to-center separation of the studs. Unlike the panels in the above-described embodiment, the studs in the panel of this and the following embodiments can be made from wood or a similar material as well as metal. If the first studs are metal, they may have horizontal metal first track sections attached to their top and bottom extremities which extend inwardly toward one another.

In another preferred embodiment, this modular building system also includes a second frame unit having a single vertical second stud. A second sheet of sheathing is attached to the second stud with one of its edges being offset from the side of the second stud by the same predetermined offset. The width of the second sheet of sheathing is no greater than the predetermined center-to-center separation of the first studs in the first modular frame unit.

In another preferred embodiment, walls are formed by joining first and second frame units together end-to-end, with an exposed margin of the piece of sheathing on one panel overlaying and being attached to the portion of the stud in the adjacent panel which the sheet of sheathing is offset from.

Another preferred embodiment of the invention relates to a modular system for framing interior walls which utilizes frame units consisting of a pair of parallel vertical studs which are joined together by top and bottom pieces.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

A first preferred embodiment of the subject invention includes a method for constructing the walls of a building from prefabricated modular building panels.

Figure 1:
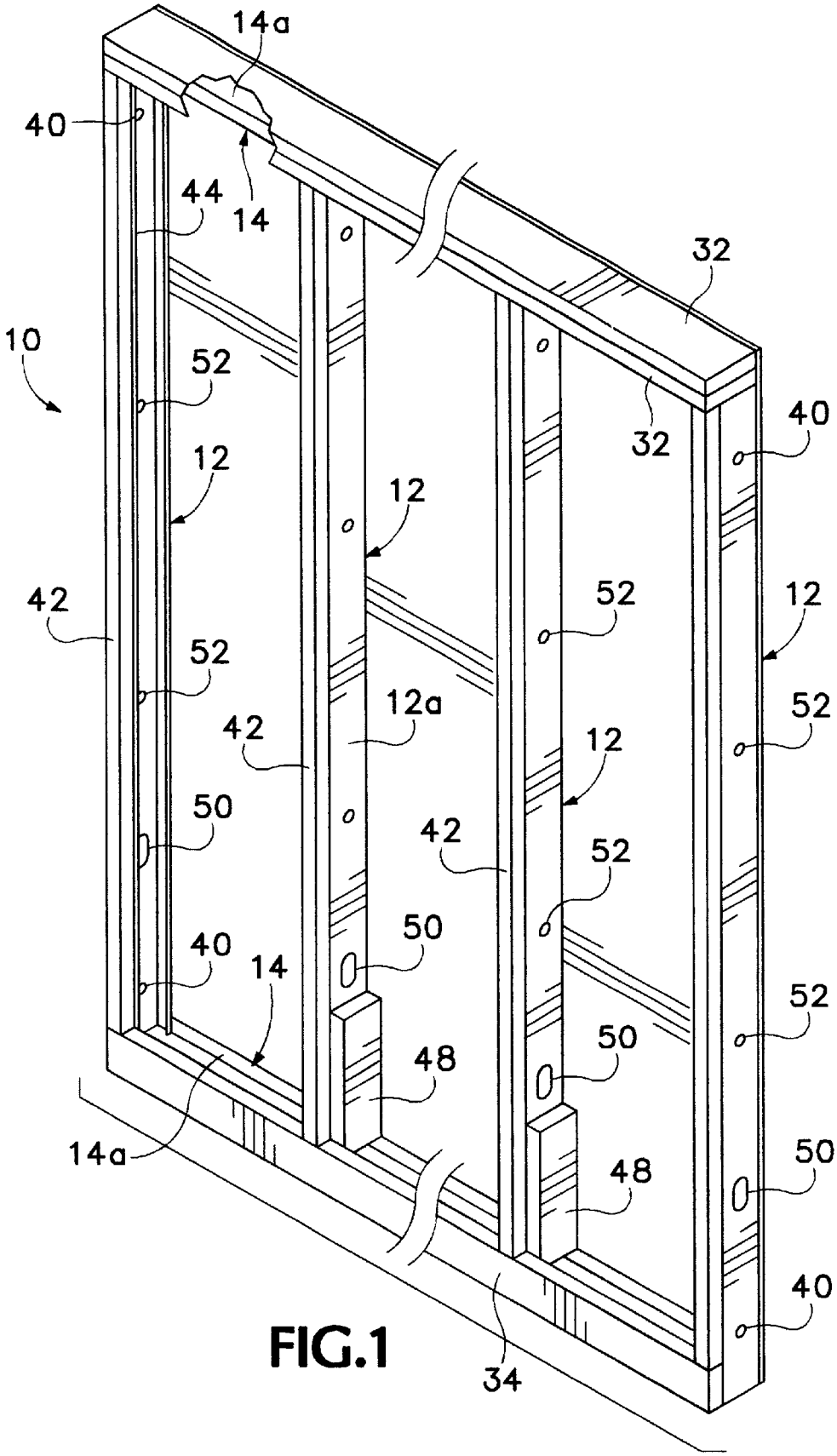
FIG. 1 is a perspective view, partially broken away, of a panel embodying the subject invention.

Referring to FIG. 1 of the drawings, the panels 10 are constructed from two or more vertical studs 12 that are interconnected at their tops and bottoms by horizontal tracks 14. A sheet of exterior sheathing 16 is attached to the outside of each panel. Most of the panels are full wall height, 8'1⅛", 9'1⅛", 10'1⅛", and they are provided in enough different widths to allow almost any length wall to be constructed from them. An example of a mix of panels that would accomplish this would be panels having widths of 4 foot and 2 foot and panels whose widths are 2 inches apart between 2 foot and 6 inches. While it would be possible to make larger panels, it is preferable that the panels are light enough to be moved and erected by one or two workers.

Figure 2:
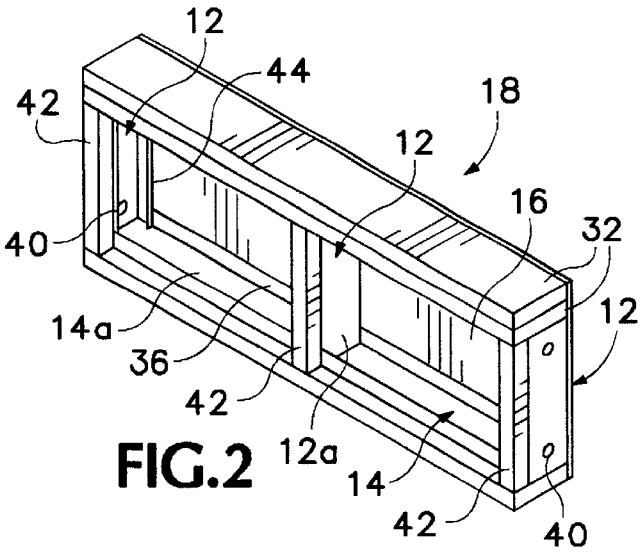
FIG. 2 is a perspective view of a shorter panel which can be used as a header or a sill.

Referring now also to FIG. 2, a certain number of less than full wall height panels are also provided. These panels serve as sills 18*a* which are located below windows, FIG. 4, and headers 18*b*, which are located above windows and doors, FIG. 5. Header panels and sill panels also are provided in different heights and widths to accommodate different size windows and doors. An example would be 84-inch, 72-inch, and 48-inch widths for both header panels and sill panels, 38-, 26- and 14-inch height for header panels and 15½-inch, 21½- and 15½-inch, 21½-inch, 27½-inch, 33½-inch and 39½-inch height for sill panels. Again, other sizes could be provided if desired, but this mix of sizes will accommodate most standard-size windows and doors.

Figure 3:
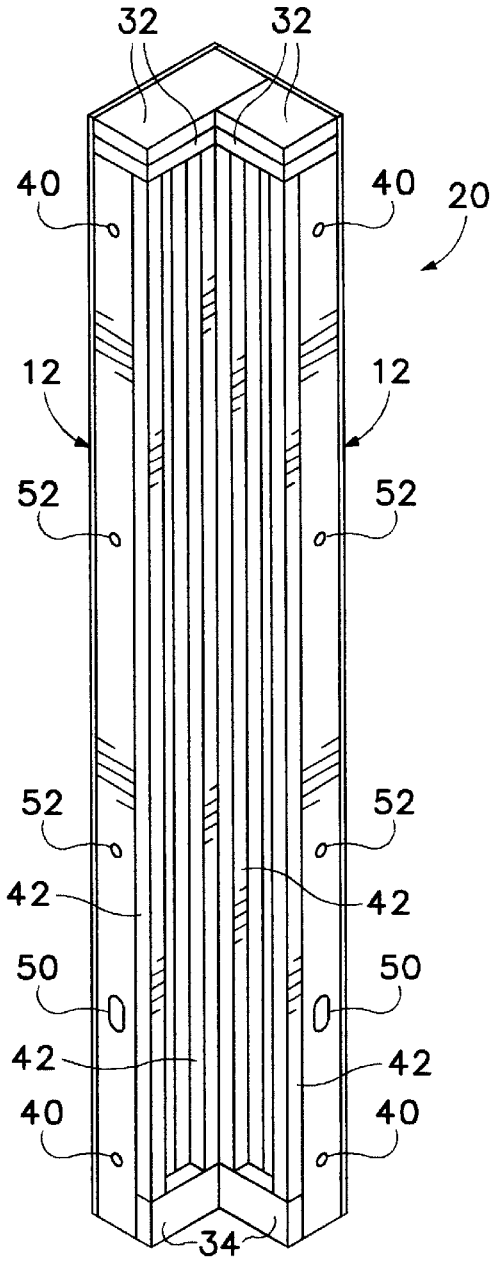
FIG. 3 is a perspective view of a corner piece used in conjunction with the panel of FIG. 1.
Figure 8:
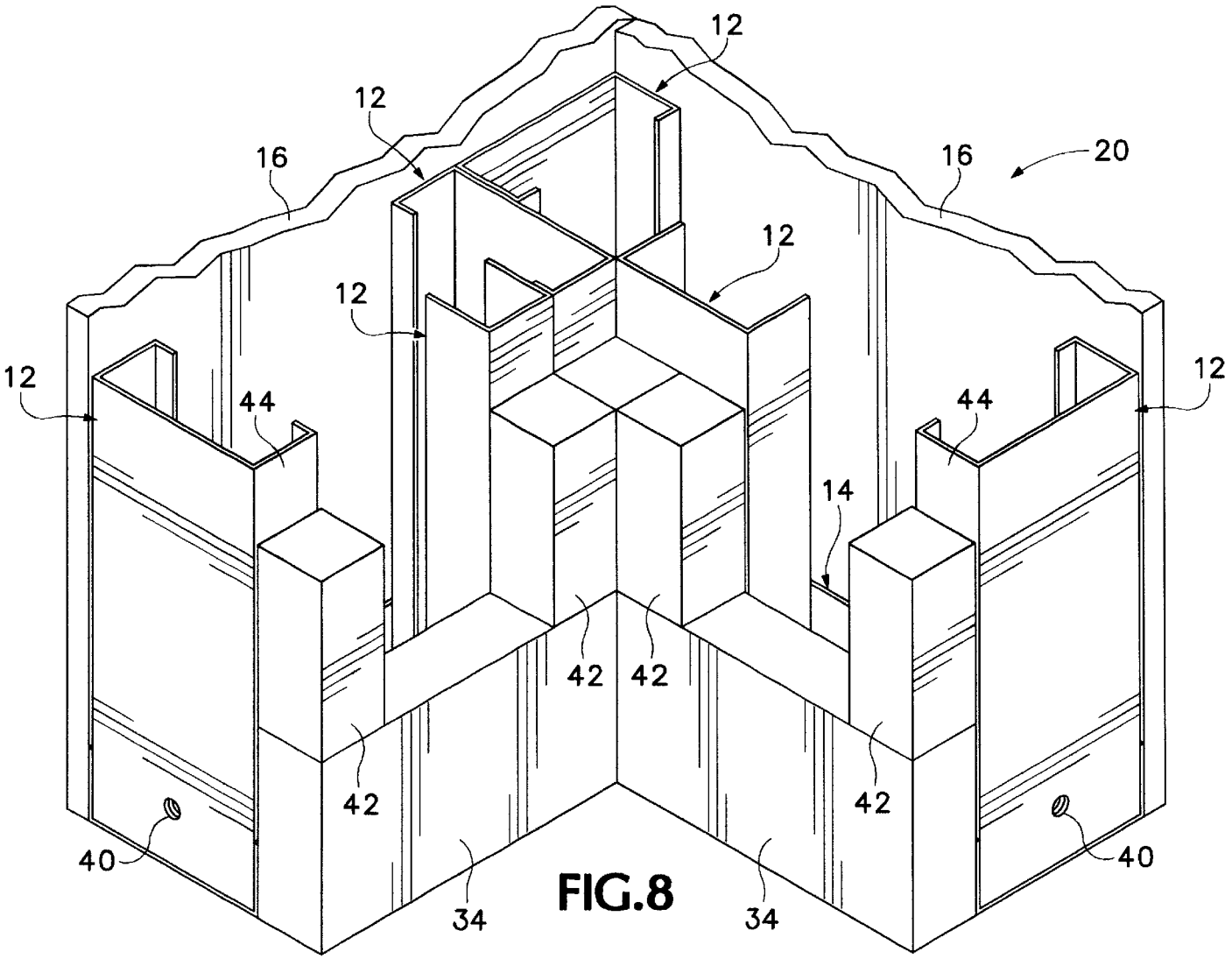
FIG. 8 is a shortened perspective view of the corner piece of FIG. 3 showing the way it is constructed.

A final component is the corner piece 20 shown in FIGS. 3 and 8. The corner piece is provided in the same heights as the full height panels 10. The corner piece has a plurality of vertical studs 12 which are interconnected at their tops and bottoms by horizontal tracks 14. The corner piece is L-shaped and the studs 12 are located at each extremity of each leg. In addition, studs are placed on each side of the inner and outer corners to facilitate attachment of facing materials. As with the panels, exterior sheathing is attached to the outside of the corner pieces.

The walls are constructed by placing one of the corner pieces 20 at each outside corner of the proposed building. Panels 10, 18 are then placed between the corner pieces to complete the walls. Header and sill panels are used where doors and windows are to be located. The panels are attached to one another and to the corner pieces by conventional construction methods, such as bolting or nailing. With inside corners, a corner piece is not necessary and the abutting walls can simply be nailed or bolted to one another.

Figure 4:
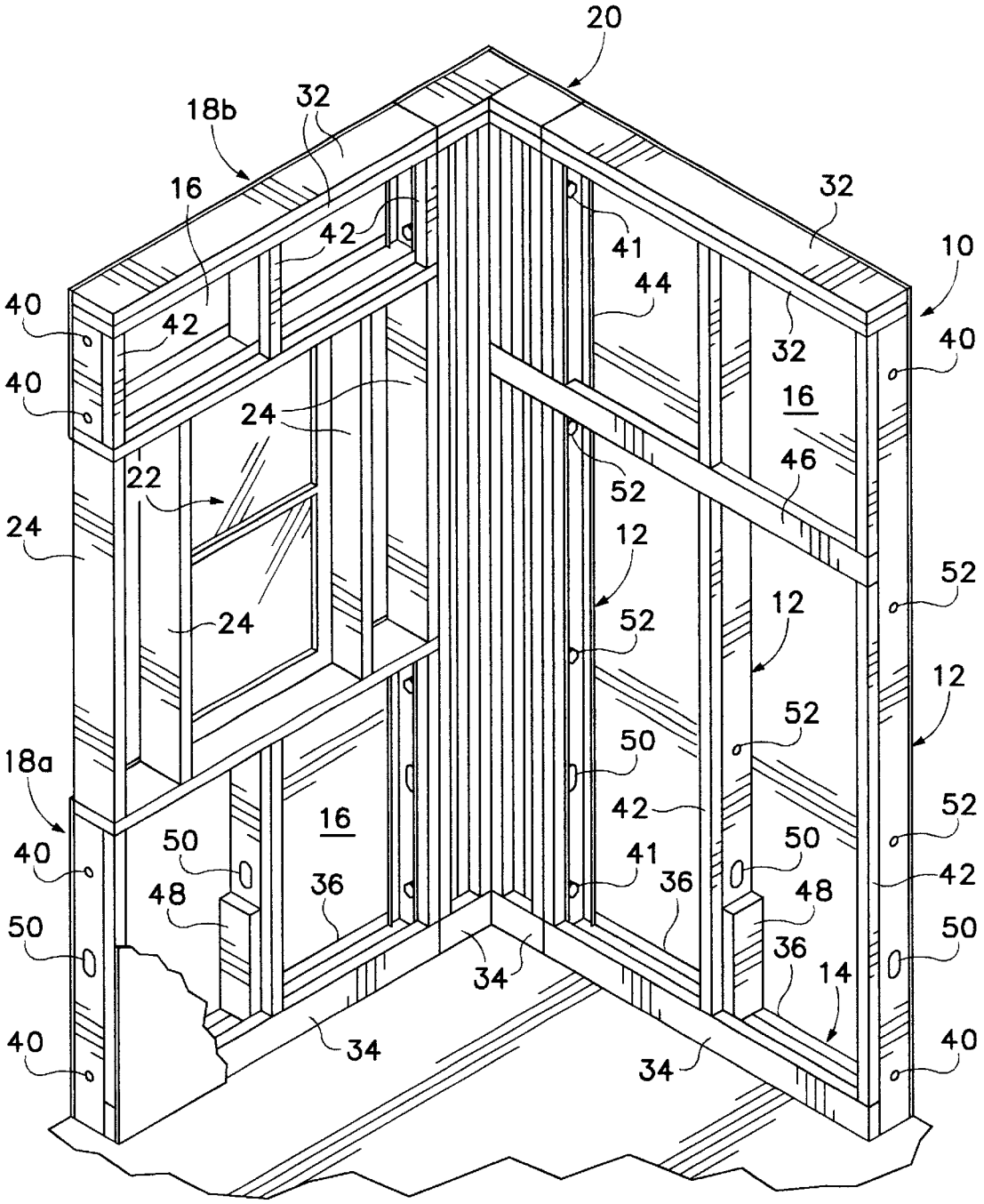
FIGS. 4 and 5 are perspective views of wall sections embodying the panels of the subject invention.
Figure 5:
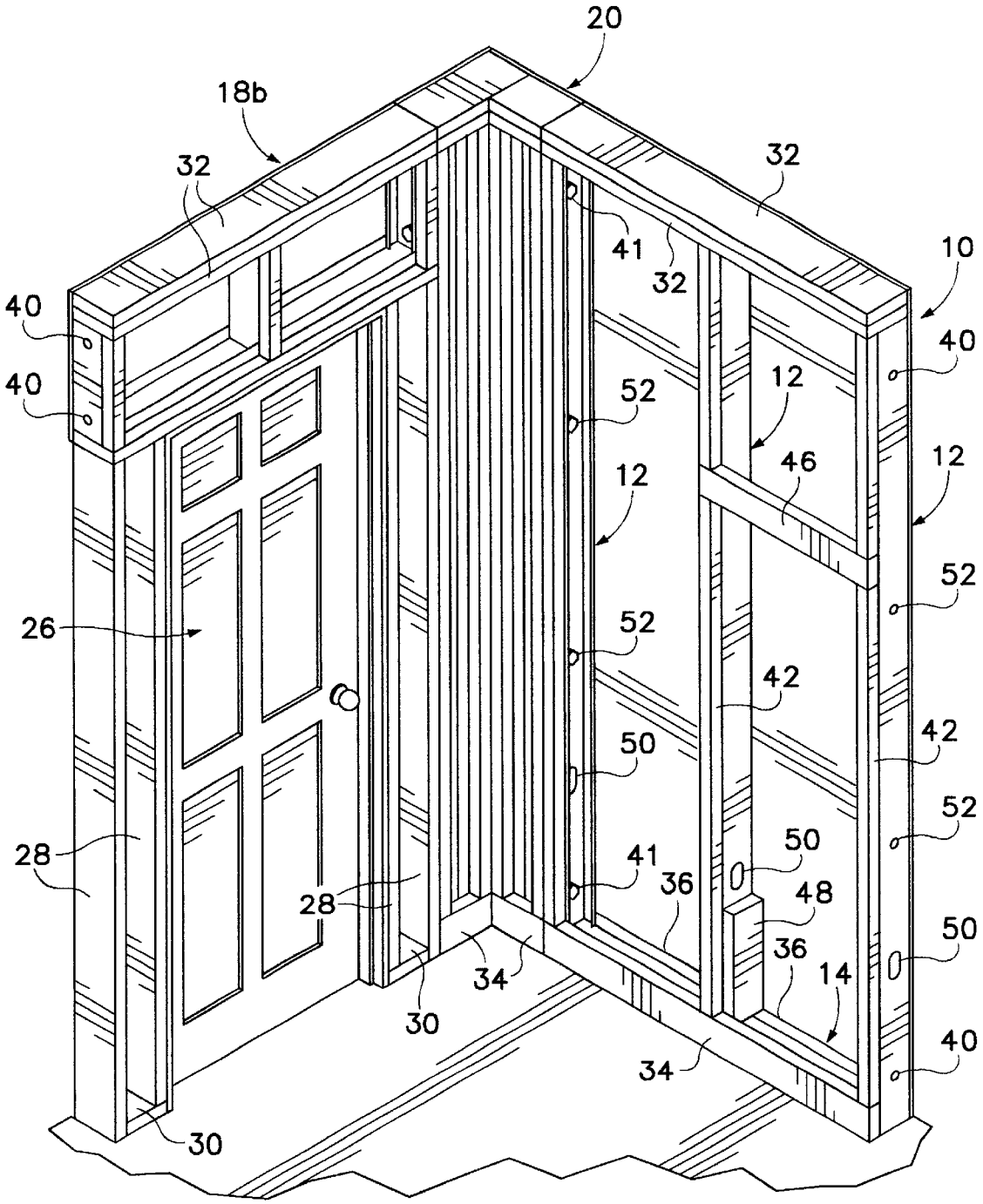

Referring to FIG. 4, when a window 22 is to be placed in a wall, header and sill panels having a width which is larger than the width of the window are selected. The sill panel has a height that is equal to the distance the bottom of the window is to be offset from the floor, and the header panel has a height that will cause it to extend between the top of the window and the top of the wall when the window is placed between the header and sill panels. The header and sill panels are then attached to the adjacent panels or corner piece with the top of the sill panel being aligned with the tops of the adjacent panels and the bottom of the header panel being aligned with the bottoms of the adjacent panels. The window is then inserted between the header and sill panels and studs 24 are placed between the header and sill panels on each side of the window and at both ends of the panels. Referring now to FIG. 5, to install a door 26 a header panel having a width which is greater than the width of the door and a height that will cause it to extend between the top of the door and the top of the wall is selected. This header panel is then attached to the adjacent panels or corner piece and the door is placed under it. Studs 28 and pads 30 are then used to frame the door to the adjacent panels.

Figure 6:
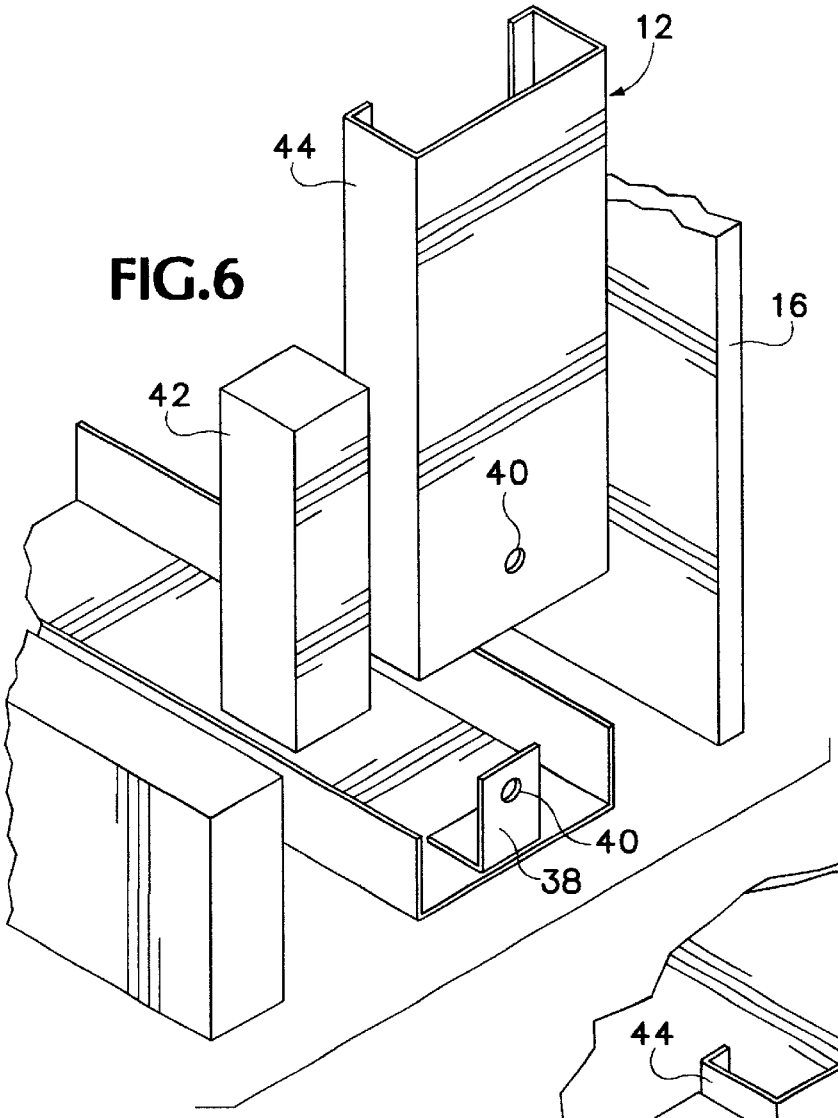
FIGS. 6 and 7 are detailed views showing how the panels are constructed.
Figure 7:
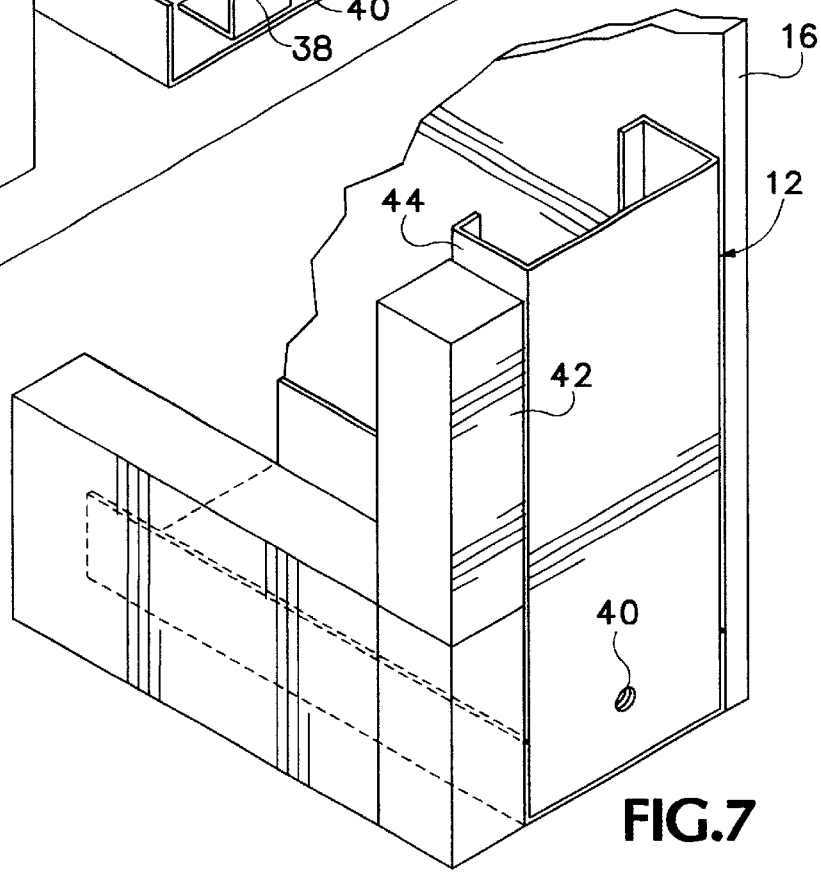

A second preferred aspect of the subject invention relates to one particular panel construction. In this panel, the studs and tracks are steel. The studs preferably are made from 400 IC 18 or 20 steel extrusions and the tracks preferably are made from 400 ST 20 extrusions. The studs and tracks are welded together on a jig to make a very rigid perfectly squared frame. At the top and bottom corner of each end stud an L-shaped stiffener 38 is welded to the stud and track to give the frame more strength and rigidity, FIG. 6. A hole 40 is drilled through the vertical leg of each stiffener and the adjacent stud to allow adjacent panels to be bolted together with bolts 41.

Rigidly attached to the tracks 14 are pieces of structural building material. In the embodiment illustrated these are dimension lumber but they could be an engineered wood product or a fiberglass or plastic substitute for dimension lumber. The top piece of lumber 32 is placed on top of the web 14*a* of the track 14 at the top of the panel. The width of the top piece of lumber exceeds the width of the track web by an amount equal to the thickness of the piece of lumber. The piece of lumber projects from the track at the front of the frame, which will be the inside of the resulting building. If the walls support a roof, a second piece of lumber 32 is used, as shown in the drawings. In the embodiment illustrated, the top piece of lumber is a 2×6. The bottom piece of lumber 34 is placed on end and is attached to the lip 36 at the front of the track 14. In the embodiment illustrated, the bottom piece of lumber 34 is a 2×4. Thus, both pieces of lumber project from the studs and track by an amount equal to their thickness, which for the size lumber illustrated is 1½ inches. It would be possible to attach the same size piece of lumber used at the top of the wall to the web of the track at the bottom of the beam also. However, as will be explained later, the foregoing arrangement is preferable. Dimension lumber is also preferable for the studs 24 and 28 used with windows and doors to allow the windows to be nailed in place and to allow wood trim to be installed.

Attached to the front of each stud is a piece of insulating material 42 having the same width as the lip 44 of the stud and a depth equal to the thickness of the piece of dimension lumber. Thus, the front of the piece of insulating material 42 is flush with the inside faces of the pieces of lumber 32 and 34, which allows a sheet of interior surface material, such as sheet rock or paneling, to be attached to the frame. The preferred insulating material is 25-pound Styrofoam foam which is adhesively attached to the studs.

The purpose of the lumber is threefold. First, the piece of lumber 32 at the top of the panel adds additional strength to the panel. Second, both pieces of lumber provide a way to tack the interior surface material to the panel quickly and easily with a hammer and nails. A screw or nail gun can then be used to attach the surface material to the studs. Third, the pieces of lumber provide a way to attach crown and base molding to the wall simply and easily with a hammer and nails. The reason the bottom piece of lumber is attached on end to the track lip rather than under the track web is to make it high enough to nail base molding to when there is a thick carpet and pad. The insulating material has two purposes. First, steel studs have a high thermal conductivity which makes it hard to provide an acceptable "R" value with steel stud walls. The use of the insulating material allows this to be accomplished. Secondly, whenever cabinets are to be hung on a wall blocks need to run across the wall behind the cabinet to provide a place for the cabinet to be attached to. This. is accomplished in normal frame construction by cutting blocks to the right size to fit between each adjacent pair of studs and then attaching them to the studs. With the subject invention strips of the insulating material 42 are removed in a line across an entire wall and a piece of dimension lumber 46, having the right depth, is set in the slots and attached to the studs, FIG. 4. Located at the bottom of each intermediate stud 12 is a block of lumber 48 which allows an electrical box to be nailed to the stud. A hole 50 is placed above each block 48 and in each end stud in order to pass wire through the studs. Holes 52 are also located in the studs to allow pipe to pass through them.

Figure 9:
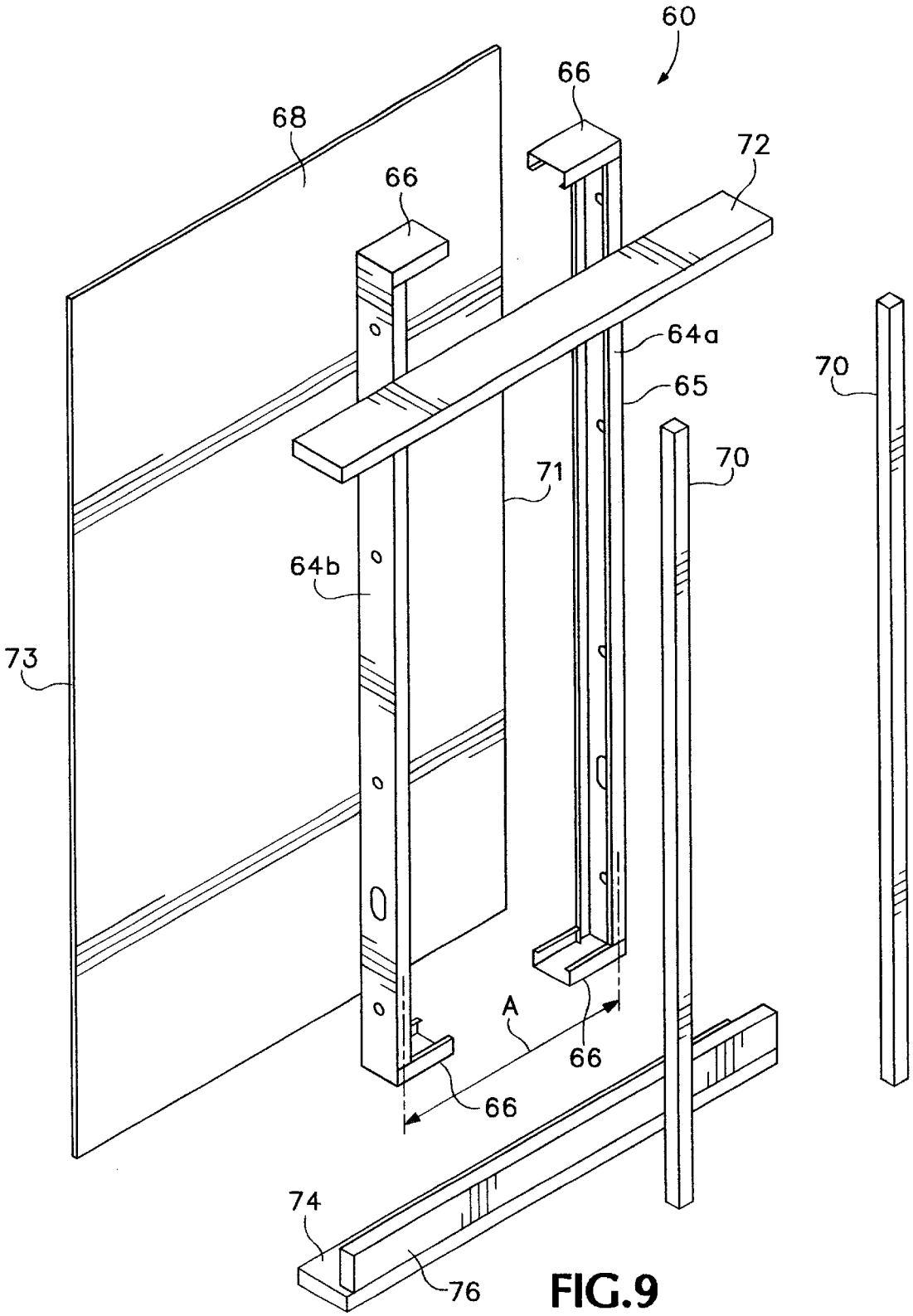
FIG. 9 is an exploded view of a panel of another embodiment of the subject invention.
Figure 10:
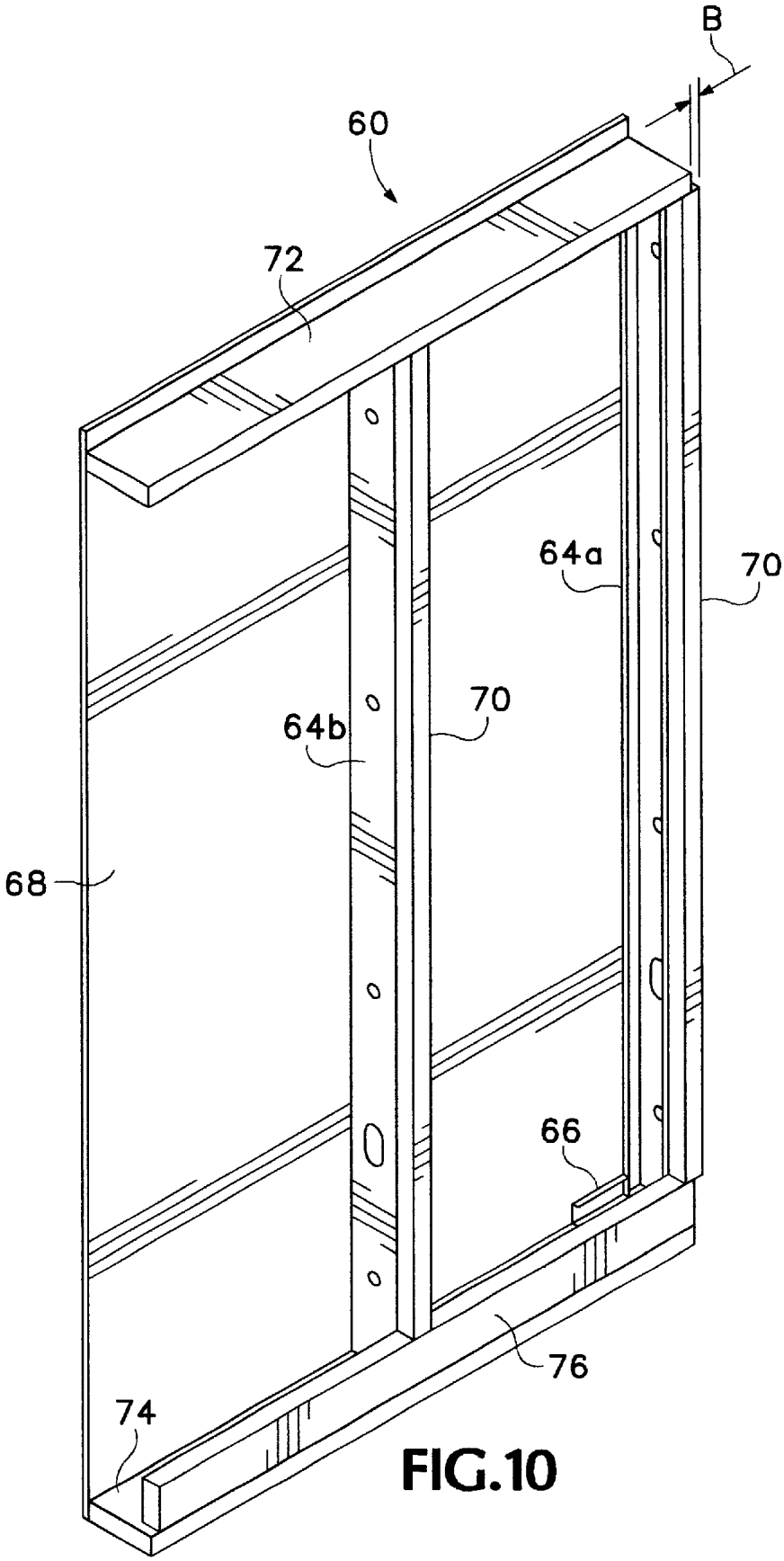
FIG. 10 is a perspective view of the panel of FIG. 9.
Figures 11, 12:
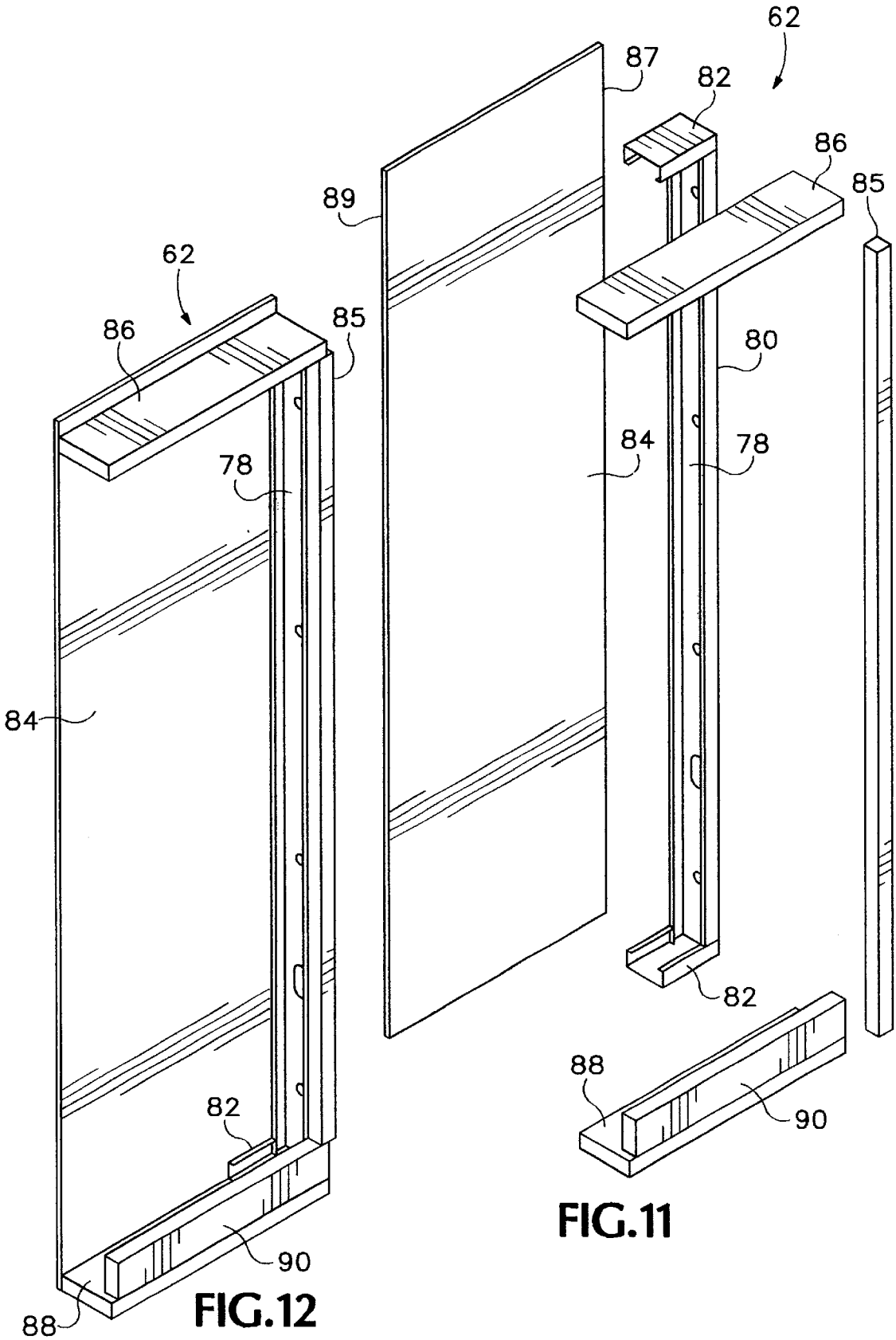
FIG. 11 is an exploded view of another panel of the subject invention.
FIG. 12 is a perspective view of the panel of FIG. 11.

Another type of panel construction is the first modular building panel 60 shown in FIGS. 9 and 10 and the second modular building panel 62 shown in FIGS. 11 and 12. These panels are joined with the corner element 92 shown in FIG. 13 and header and sill panels to provide a modular building system that will be explained more fully later.

The first modular building panel 60 includes a pair of first studs 64*a* and 64*b*. While the first studs illustrated in the drawings are metal, they could be made from any structural building material, such as wood, an engineered wood product, fiberglass or plastic. While the metal first studs shown in the drawings have a C-shaped cross section, if the first studs were fabricated from most other types of material, they would be rectangular. One of the first studs, 64*a,* is at the outside of the panel and the other first stud, 64*b,* is proximate the middle of the panel. The first studs are oriented vertically and the outside first stud 64*a* forms a vertical side 65 of the panel. The first studs 64*a* and 64*b* are separated from one another by a predetermined center to center separation A. Together the first studs 64*a* and *b* form a first frame unit. With the metal studs illustrated, it may be desirable to have horizontal metal first track segments 66 attached to the top and bottom extremities of each stud. The first track segment 66 projects inwardly towards one another.

Attached to one side of the first frame unit is a rectangular first sheet of sheathing 68. The first sheet of sheathing has a first edge 71 which is inwardly offset from the side 66 of the first stud 64*a* by a predetermined offset B. The first sheet of sheathing 68 has a width which is equal to twice the predetermined center-to-center separation A of the first stud 64*a* and *b* and it has a second edge 73 which is opposite from and parallel to the first edge.

The first modular panel 60 may have first pieces of structural building material 72, 74 and 76 attached to the tops of the first track segment 66 at the top of the first studs and to the bottoms of the track segment, at the bottoms of the first studs; or, in the case of non-metal studs, to the studs themselves. Like the previously described panels, the first pieces of structural building material are shown as dimension lumber, but they could be another material. The first pieces of lumber 72, 74 and 76 have a length which is equal to the width of the first piece of sheathing 68, and are aligned with it. With metal first studs, the first pieces of lumber may have a width which is wider than the width of the webs of the track segment 66 by a second predetermined amount so that they project from the front of the first frame unit. Preferably this second predetermined amount is equal to the thickness of the first pieces of lumber. If the first pieces of lumber have a width which is greater than the track webs, a piece of insulation material 70 having the same width as the lip on the stud and a thickness equal to the second predetermined amount is attached to the front of each stud.

In the embodiment illustrated, a single first piece of lumber 72, having a width equal to the width of the web of the track segment plus the second predetermined amount, is attached to the track sections 66 at the top of the first studs 64*a* and *b*. A similar first piece of lumber 74 is attached horizontally to the track segments 66 at the bottoms of the first studs. In addition, a first piece of lumber 76, having a width equal to the second predetermined amount, is placed vertically on top of the horizontal piece of lumber 74 next to the lips of the track segments. The first piece of sheathing preferably has as height which allows it to extend above the top piece of lumber 74 by a distance equal to one half of the second predetermined amount. This permits another piece of dimension lumber 100 to be placed on top of the piece 72, as will be more fully explained later. If a second story is added the one half of the other piece of lumber 100 will be covered by the upper story sheathing. If there is no second story it will remain uncovered.

The second modular panel 62, FIGS. 11 and 12, has a single vertical second stud 78. As with the first panel, second stud 78 is shown as being metal, but it could also be made from other materials. The outside face of the second stud 78 forms a vertical side 80. If the second stud is metal, second track segments 82 may be attached to its extremities. The second stud 78 forms a second frame unit.

Attached to one side of the second frame unit is a rectangular second sheet of sheathing 84. The second sheet of sheathing has a first edge 87 which is inwardly offset from the side 80 of the first stud 78 by the same pre-determined offset B as is the case with the first panel 60. The second sheet of sheathing can have any desired width so long as it does not exceed the center-to-center distance A. Preferably second sheets of sheathing would be provided with a range of widths similar to the panels 10. The second sheet of sheathing has a second edge 89 which is opposite from and parallel to the first edge.

As with the first panel, the second panel may have a piece of structural building material attached to the top and bottom of the second track segments 82, if the second studs are metal, or to the second studs themselves if they are not metal. With metal studs the structural building material pieces may be wider than the webs of the track segments by the second predetermined amount and a piece of insulating material 85 may be attached to the stud.

In the embodiment illustrated, the piece of building material at the top of the panel is a single second piece of lumber 86 similar to piece 72 and there are two second pieces of lumber, 88 and 90, at the bottom of the panel which are similar to the first pieces of lumber 74 and 76. The pieces of lumber 86, 88 and 90 have a length which is equal to the width of the second sheet of sheathing 84 and are aligned with it. As with the first panel, the second sheet of sheathing 84 extends from the bottom of the bottom second piece of lumber 88 to a distance equal to the second predetermined distance above the top second piece of lumber 86.

Figure 13:
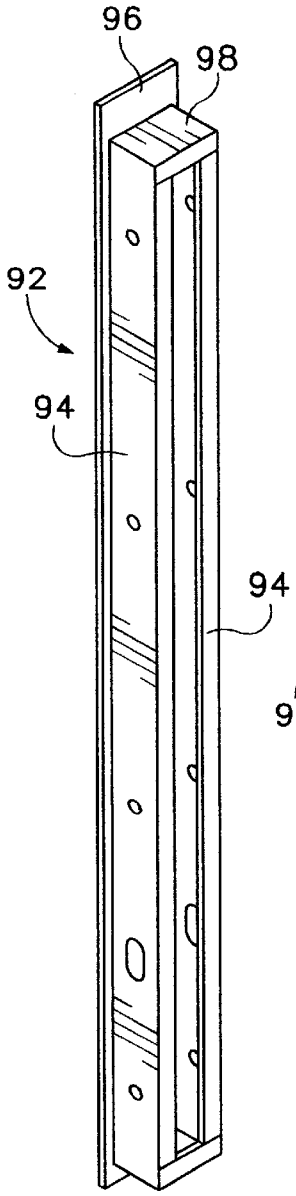
FIG. 13 is a perspective view of a corner element of the subject invention.
Figure 14:
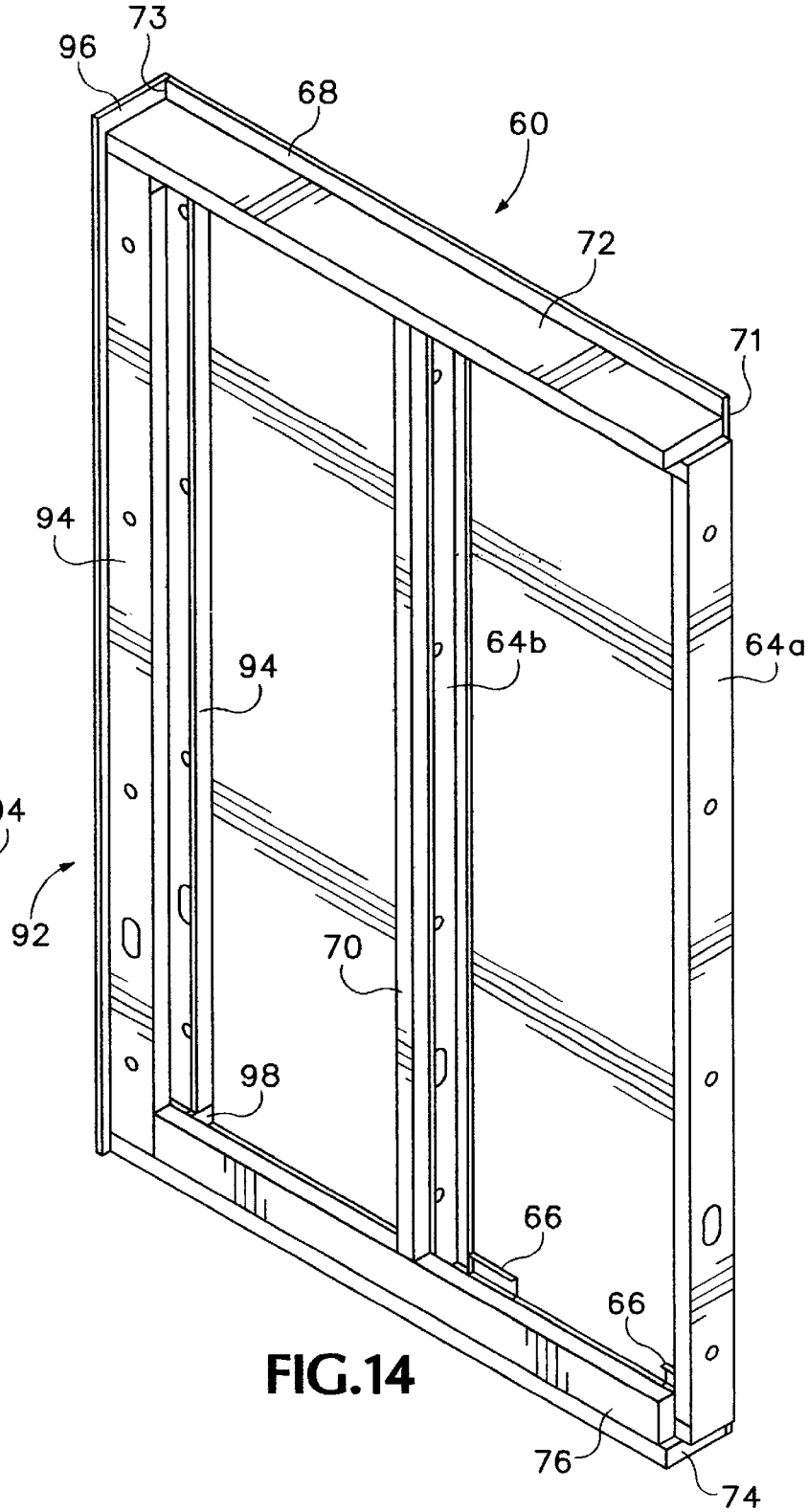
FIG. 14 is a perspective view of a wall section constructed from one of the panels of FIG. 10 and the corner unit of FIG. 13.

The final element of the modular building system is the corner element 92 shown in FIGS. 13 and 14. The corner element includes a pair of parallel vertical third studs 94 having a third rectangular sheet of sheathing 96 attached to one side. The third piece of sheathing 96 projects out from one side of the corner piece by a distance equal to the second predetermined amount, and out from the other side by an amount equal to the thickness of the sheathing. With metal third studs the studs are interconnected at their tops and bottoms by horizontal tracks 98. With metal third studs the width of the corner piece is equal to the width of the studs in the first and second panels plus the second predetermined amount. With wood or similar types of studs the width of the corner piece is equal to the width of the studs. The corner piece does not have a piece of structural building material attached to it like the first and second building panels do.

Figure 16:
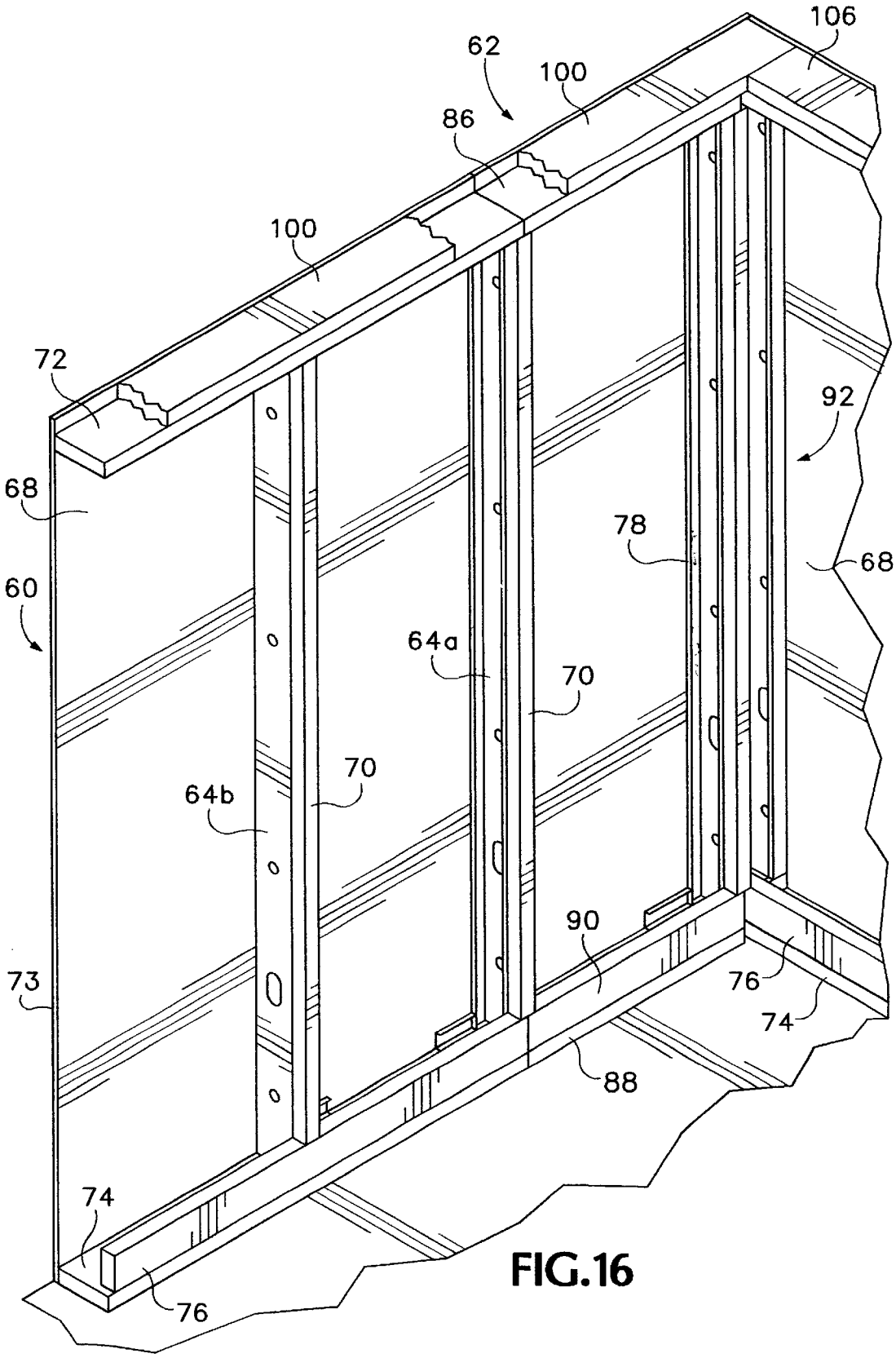
FIG. 16 is a perspective view of a wall section constructed from multiple panels of FIG. 10 and FIG. 12 and the corner unit of FIG. 13.

Referring now to FIGS. 14 and 16, wall segments can be constructed by joining first and second panels 60, 62 and corner elements 92 together in any desired combination. FIG. 14 shows a first panel 60 attached to a corner element 92. This is accomplished by butting the second edge 73 of the first piece of sheathing 68 on the first panel up against an edge of the third piece of sheathing 96 on the corner element 92. When this occurs the top and bottom first pieces of lumber 72, 74 overlie the tracks 98 at the top and bottom of the corner element and the margin of the first sheet of sheathing adjacent to the second edge 73 overlies the web of one of the third studs 94 on the corner element. The first pieces of lumber 72 and 74 are attached to the tracks 98 and the margin of the first sheet is attached to the web with standard wood to metal fasteners.

Figure 15:
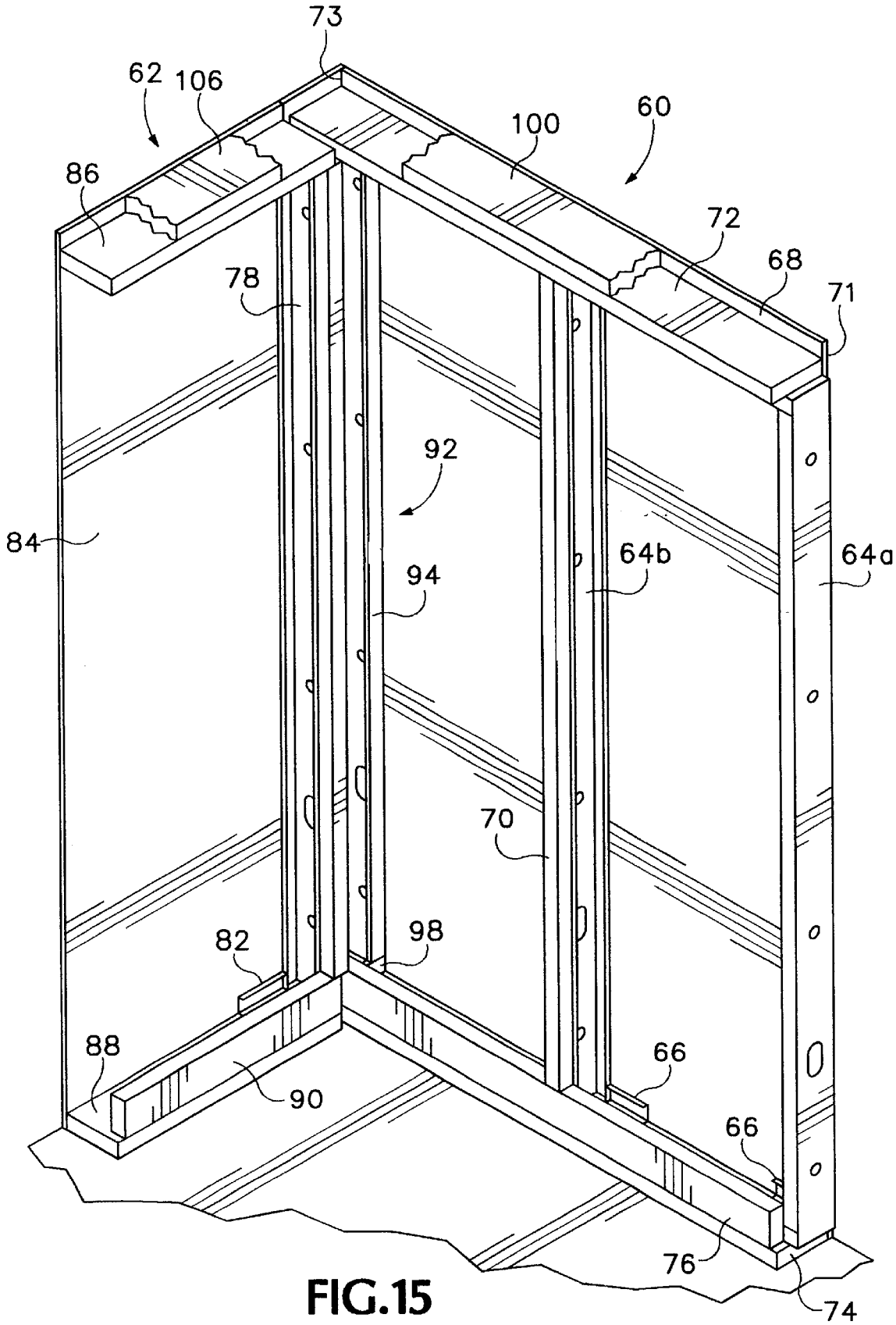
FIG. 15 is a perspective view of a wall section constructed from multiple panels of FIG. 10 and FIG. 12 and the corner unit of FIG. 13.

Referring now also to FIG. 15, a second panel 62 is added to the other side of the corner element by abutting the second stud 78 against the opposite third stud 94 of the corner element. The projecting margin of the third sheet of sheathing on the corner element overlies the exposed edge of the second stud 78 on the second panel and these elements are attached to one another with suitable fasteners also.

A first panel 60 can then be attached to a second panel, FIG. 16. In fact, the first and second panels and corner elements can be joined together in almost any array desired. A first panel can be attached to another first panel or to a second panel. A second panel can be attached to another second panel or to a first panel. Either a first or second panel can be attached to a corner element on either of its sides. Window and door openings are provided by using sills and headings similar to those described in the first embodiment of the invention. Typically first panels would be used to build long walls and as a wall approached an opening or a corner a proper width second panel would be inserted to complete the wall. In any event, panels and corner elements are quickly attached together by attaching the margin of the sheet of sheathing on one panel to the exposed portion of the end stud on the adjacent panel.

Once the appropriate first and second panels and corner elements are joined to form a wall a second piece of structural building material 100 is placed on top of and attached to the first and second pieces of building material 72, 86 to add load-carrying capability to the wall and to further tie the various elements in place.

Figure 17:
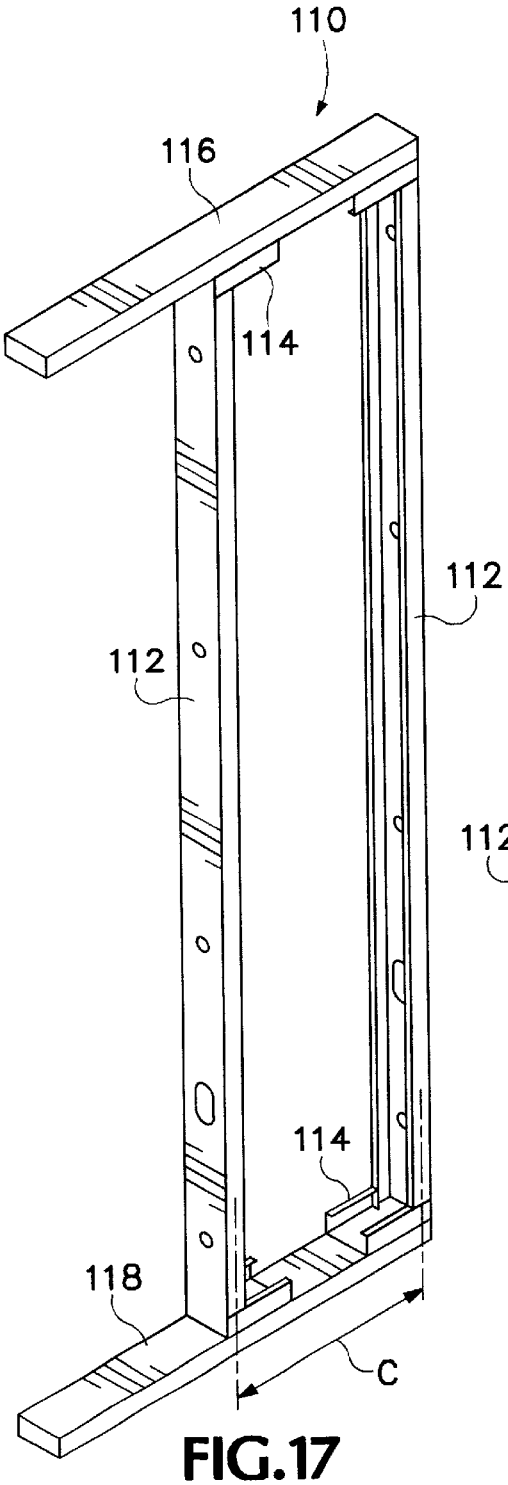
FIG. 17 is a perspective view of an interior wall panel of another embodiment of the subject invention.
Figure 18:
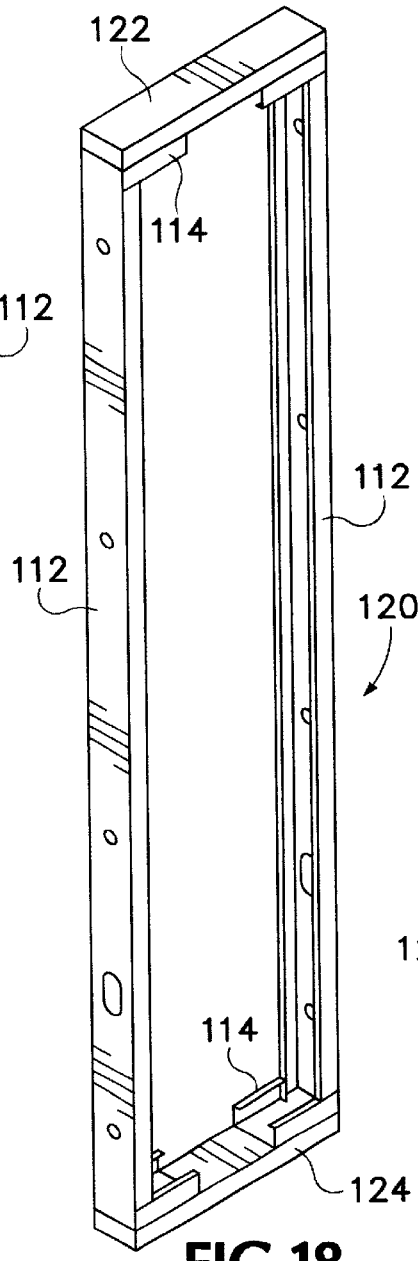
FIG. 18 is a perspective view of another interior wall panel.
Figure 19:
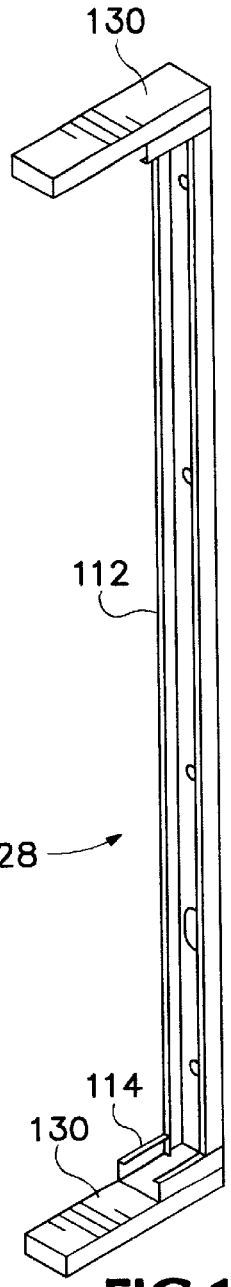
FIG. 19 is a perspective view of yet another interior wall panel.
Figure 20:
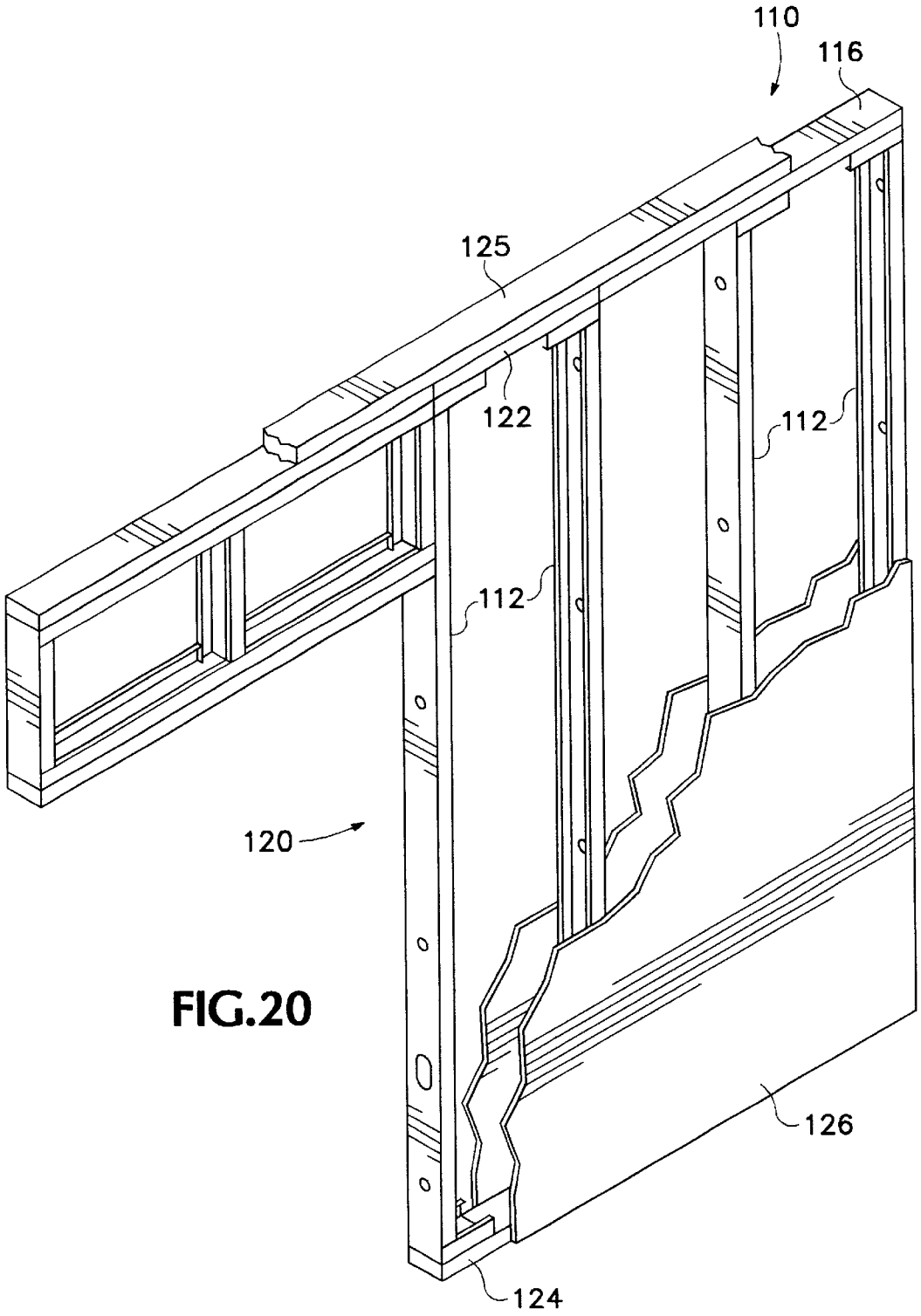
FIG. 20 is a perspective view of a wall section constructed from the panels of FIGS. 17 and 18.
Figure 21:
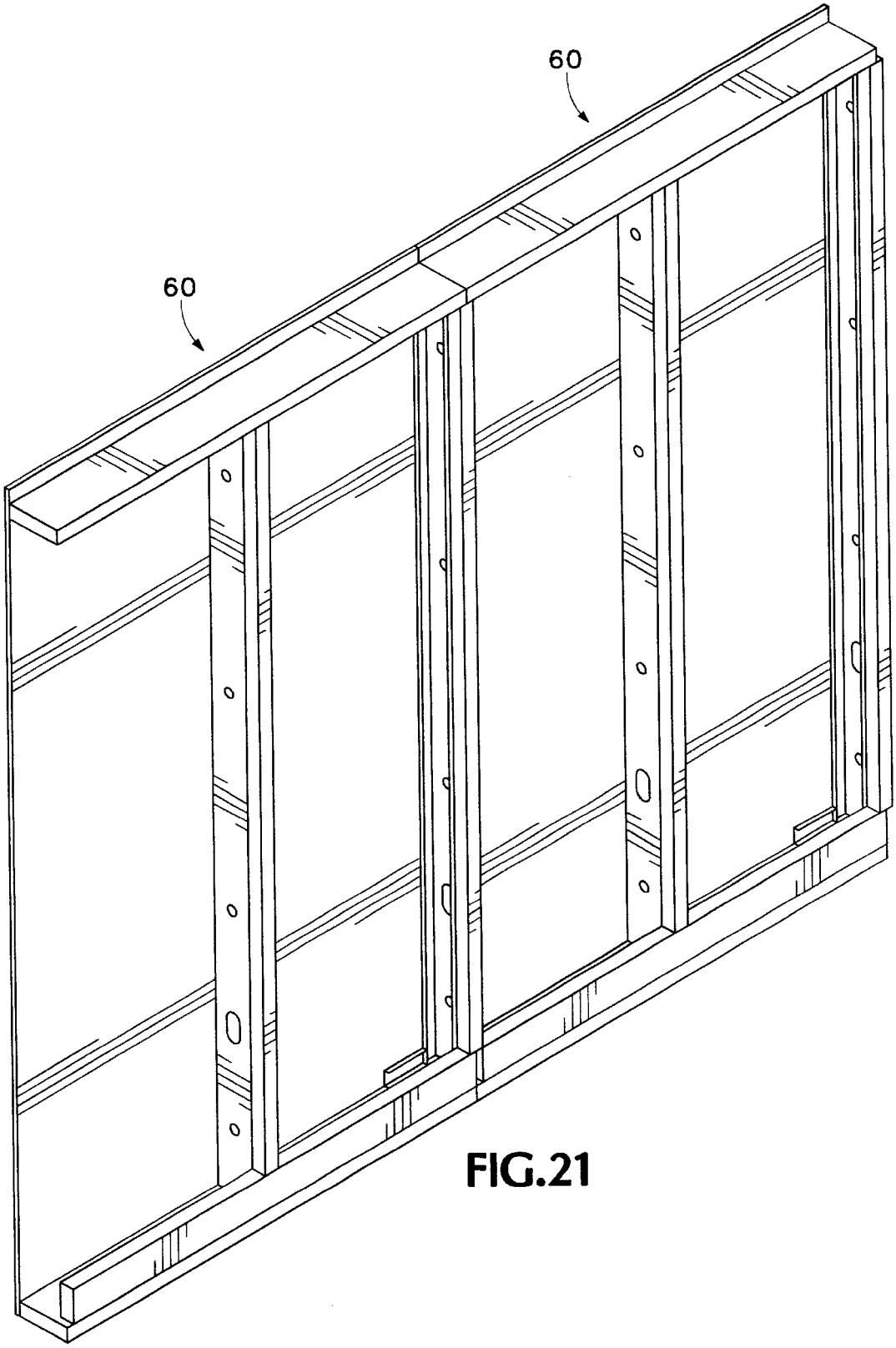
FIG. 21 is a perspective view of two of the panels of FIG. 10 joined together end-to-end.
Figure 22:
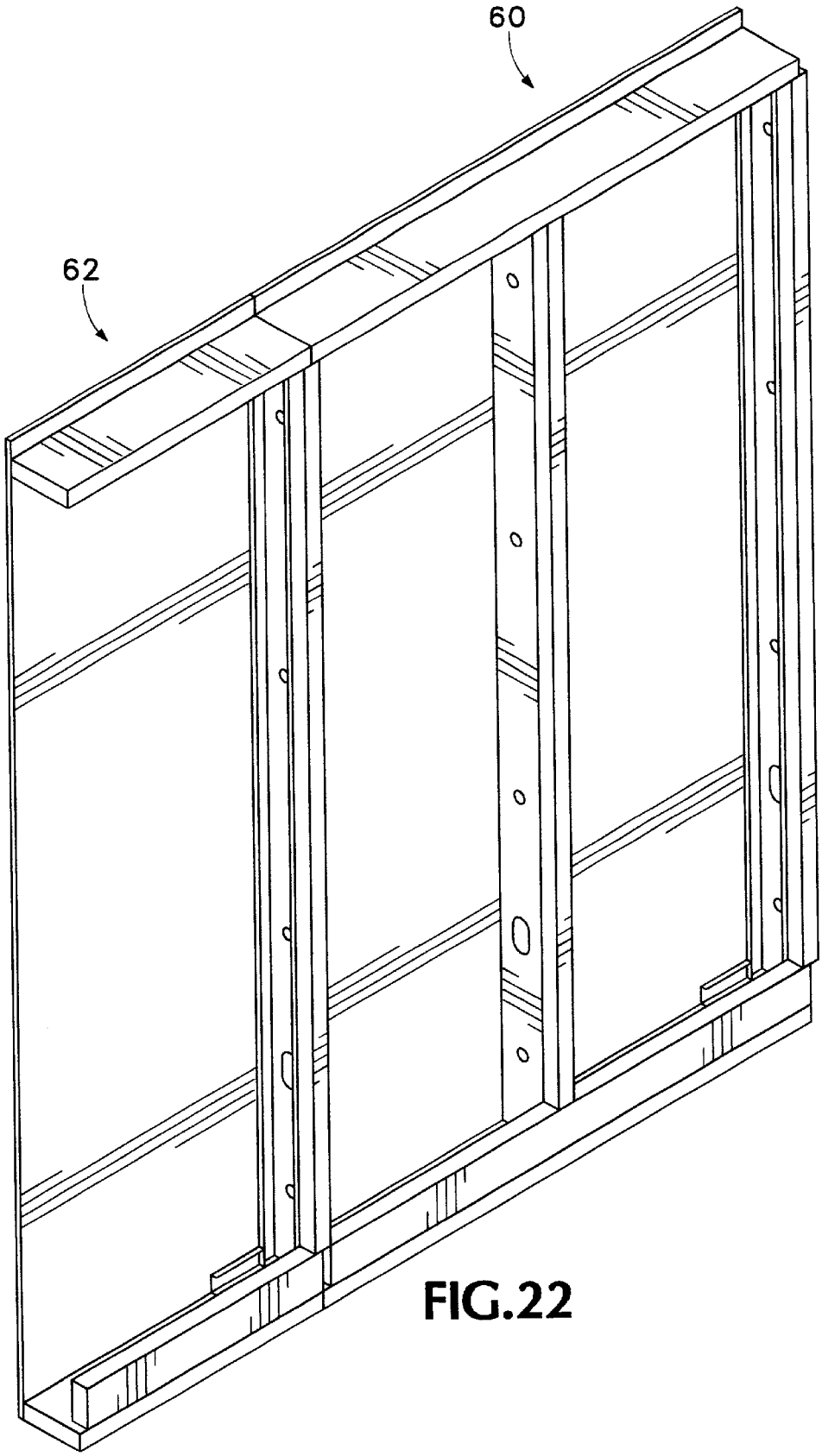
FIG. 22 is a perspective view of one of the panels of FIG. 10 joined end-to-end with one of the panels of FIG. 12.

Another embodiment of the invention, shown in FIGS. 17, 18 and 19, relates to a modular system for framing interior walls. This system includes a long frame unit 110, FIG. 17, which has a pair of parallel vertical studs 112 which are separated by a predetermined center-to-center distance C. The studs 112 are shown in the drawing as metal studs, but again they could be made from wood, an engineered wood product, fiberglass or plastic. As with the studs for exterior walls, if the studs 112 are metal, they may have track segments 114 projecting from their upper and lower extremities. The studs are interconnected at their top and bottom extremities by top and bottom pieces 116, 118 which again can be any material but typically would not be metal to enable SHEETROCK or paneling to be nailed to them. The top and bottom pieces 16 and 18 have a length which is equal to twice the predetermined center-to-center separation C, and project out from one side of the frame unit.

The system also includes medium frame unit 120, FIG. 18. The medium frame units are identical to the long frame unit 110 except that the top and bottom pieces 122, 124 have a length which is equal to the width of the frame unit. In the medium frame unit the studs are separated by a distance equal to the predetermined center-to-center separation C.

Finally, the system includes a short frame unit 128, FIG. 19. the short frame unit has a single stud 112 which, if it is metal, may have track segments projecting from its upper and lower extremities. Projecting from the upper extremity of the stud is short pieces of building material 130, and projecting from the lower extremity of the stud is a short piece of building material 132. Preferably, the overall length of the short frame cut is 6 inches.

Referring to FIG. 19, a wall is constructed with this system by placing end-to-end as many long frame units as is required to construct the wall. A short or medium-frame unit can then be used to complete the wall. The frame units are assembled to one another lying flat on the floor of the structure and once they are assembled, pieces of building material 125 can be attached to the top pieces 116, 122 and 130 and the bottom pieces 118, 124 and 132 to form a wall.

The wall is then tilted up and attached to the remainder of the structure by traditional means. Headers 128 can be installed between studs 112 and below the piece of building material 125 to make openings for doors. SHEETROCK 126 is then attached to both sides of the walls in the normal manner.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A modular building system comprising a first modular building panel which includes:

(a) a first frame unit including two parallel vertical first studs which form spaced-apart vertical sides of said frame unit;

(b) said first studs having a predetermined center-to-center separation therebetween;

(c) a first rectangular sheet of sheathing attached to said first frame unit, on one side thereof, said first sheet of sheathing having a first edge which overlies a portion of a first one of said studs and is inwardly offset from the side of said first frame unit defined by said first one of said studs by a predetermined offset;

(d) said first sheet of sheathing having a width equal to twice said predetermined center-to-center separation, and a second edge which is opposite said first edge and is outwardly offset from the side of said first frame unit defined by a second one of said studs; wherein (e) there are no vertical first studs underlying said sheet of sheathing between said second edge and said second one of said studs.

2. The modular building system of claim 1 wherein said first studs are metal and said first building panel further comprises first horizontal metal track segments attached to each stud in said pair of first studs at the top and bottom extremities thereof and extending inwardly toward the other stud.

3. The modular building system of claim 2 wherein said first building panel further comprises:

(a) first pieces of structural building material which are rigidly attached to said first track segments and project from said first track segments by a second predetermined amount; and (b) strips of insulating material which are attached to said first studs having a thickness substantially equal to said second predetermined amount.

4. The modular building system of claim 3 wherein said first studs and said first track segments have webs having a first predetermined width and radially inwardly projecting lips on the front and rear edges thereof, and:

(a) one of said first pieces of structural building material which is attached to the first track segment at the top of said first panel has a width substantially equal to the sum of said first predetermined width and second predetermined amount and is placed on top of the webs of said first track segments; and (b) the first pieces of structural building material which are attached to the track segments at the bottom of said first panel include a bottom piece which has a width substantially equal to the sum of said first predetermined width and second predetermined amount, and is placed on the bottoms of the webs of said first track segments, and a vertical piece which has a width equal to said second predetermined amount and is placed beside the lips of said first track segments.

5. The modular building system of claim 1 including a second modular building panel which comprises:

(a) a second frame unit including a single vertical second stud, said second stud having a vertical side;

(b) a second rectangular sheet of sheathing which is attached to said second frame unit, said second sheet of sheathing having a first edge which is inwardly offset from said vertical side by said predetermined offset and a second edge which is opposite said first edge; and (c) said second sheet of sheathing having a width which is no greater than said predetermined center-to-center separation.

6. The modular building system of claim 5 wherein said second building panel further comprises horizontal metal second track segments attached to said second stud at the top and bottom extremities thereof and extending away from said vertical side.

7. The modular building system of claim 4 including a second modular building panel which comprises:

(a) a second frame unit including a single vertical metal second stud having a horizontal metal second track segment attached to the top and bottom extremities thereof which project inwardly therefrom, said second stud having a vertical side;

(b) a second rectangular sheet of sheathing which is attached to said second frame unit, said second sheet of sheathing having a first edge which is inwardly offset from said vertical side by a predetermined offset and a second edge which is opposite said first edge;

(c) said sheet of sheathing having a width which is no greater than said predetermined center-to-center separation;

(d) second pieces of structural building material which are rigidly attached to said second track segments and project from said second track segments by said second predetermined amount; and (e) strips of insulating material which are attached to said studs having a thickness substantially equal to said second predetermined amount.

8. The modular building system of claim 7 wherein said second studs and said second track segments have webs having a first predetermined width and radially inwardly projecting lips on the front and rear edges thereof; and (a) one of said second pieces of structural building material which is attached to the second track segments at the top of said second panel has a width substantially equal to the sum of said first predetermined width and said second predetermined amount and is placed on top of the webs of said second track segments; and (b) the second pieces of structural building material which are attached to the second track segments at the bottom of said second panel include a bottom piece which has a width substantially equal to the sum of said first predetermined width and said second predetermined amount, and is placed on the bottoms of the webs of said second track segments and a vertical piece having a width equal to said second predetermined width and is placed beside the lips on said second track segments.

9. The modular building system of claim 1 including a modular building corner element which comprises:

(a) a pair of parallel, spaced-apart metal third studs which form spaced-apart vertical sides;

(b) a third sheet of sheathing attached to said studs, on one side thereof, said third sheet of sheathing having a thickness; and (c) said third sheet of sheathing having a width which causes one edge to extend outwardly from one of said vertical sides by an amount equal to said predetermined offset and to extend outwardly from the other of said vertical sides by an amount which is equal to the thickness of said sheet of sheathing.

10. A first building wall segment comprising two of the first building panels of claim 1 interconnected end to end, with a margin adjacent to the second edge of the first sheet of sheathing on one panel having a width equal to said predetermined offset being attached to the first stud that underlies the first edge of the first sheet of sheathing on the adjacent panel.

11. A second building wall segment comprising one of the first building panels of claim 1 interconnected end to end with one of the second building panels of claim 5 with a margin adjacent to the second edge of the first sheet of sheathing on the first building panel having a width equal-to said predetermined offset being attached to the second stud of said second building panel.

12. A third building wall segment comprising one of the second building panels of claim 5 interconnected end to end with one of the first building panels of claim 1 with a margin adjacent to the second edge of the second sheet of sheathing on the second building panel having a width equal to said predetermined offset being attached to the first stud that underlies the first edge of the first sheet of sheathing on said first building panel.

13. A modular system for forming an interior wall comprising:

(a) a long frame unit including a pair of parallel vertical studs;

(b) said studs having a predetermined center-to-center separation there between;

(c) a long top piece which interconnects said studs at the upper extremities thereof;

(d) a long bottom piece which interconnects said studs at the lower extremities thereof;

(e) said long top and bottom pieces having a length equal to twice said predetermined center-to-center separation so that portions of said long top and bottom pieces extend outwardly from said long frame unit; wherein (f) there are no vertical studs extending between the portion of said long top and bottom pieces which extend outwardly from said long frame unit.

14. The modular building system of claim 13 further comprising:

(a) a medium frame unit including a pair of parallel vertical studs;

(b) said studs having said predetermined center-to-center separation therebetween;

(c) a medium top piece which interconnects said studs at the upper extremities thereof;

(d) a medium bottom piece which interconnects said studs at the lower extremities thereof; and (e) said medium top and bottom pieces having a length equal to the width of said medium frame unit.

15. The modular system of claim 14 further including:

(a) a short frame unit including a single vertical stud;

(b) a short top piece which projects from said stud at the upper extremity thereof;

(c) a short bottom piece which projects from said stud at the lower extremity thereof; and (d) said short top and bottom pieces having a length which is less than said predetermined center-to-center separation.

16. A wall assembly comprising at least one long frame unit of claim 13 and at least one medium frame unit of claim 14 located end-to-end with a piece of structural building material overlying said long and medium top pieces.

* * * * *